US006070033A

United States Patent [19]

Hiraoka et al.

[11] Patent Number: 6,070,033

[45] Date of Patent: May 30, 2000

[54] CHARGING DEVICE FOR AN ELECTROPHOTOGRAPHIC IMAGING FORMING SYSTEM UTILIZING THIN FILM CONDUCTING MEMBERS

[75] Inventors: Yuji Hiraoka, Tokorozawa, Japan; Boba Wang, Palos Ver Estates, Calif.; Sheng-Jeng Chang, Hsinchu; Ming-Chu Wu, Chupei, both of Taiwan

[73] Assignee: Aetas Peripheral Corporation, Wilmington, Del.

[21] Appl. No.: 08/982,802

[22] Filed: Oct. 6, 1997

Related U.S. Application Data

[60] Provisional application No. 60/027,535, Oct. 7, 1996.

[51] Int. Cl.[7] ..... G03G 15/02

[52] U.S. Cl. ..... 399/170; 250/324; 250/326; 361/230; 399/173

[58] Field of Search ..... 399/168, 170–173; 250/324–326; 361/220, 222, 223, 225, 230

[56] References Cited

U.S. PATENT DOCUMENTS

| | | | |
|---|---|---|---|
| 3,970,905 | 7/1976 | Itoh et al. | 361/233 |
| 4,922,099 | 5/1990 | Masuda et al. | 250/324 |
| 5,412,213 | 5/1995 | Kido et al. | 250/326 |
| 5,466,938 | 11/1995 | Nakayama et al. | 250/326 |
| 5,666,604 | 9/1997 | Nakagami et al. | 399/171 |
| 5,742,871 | 4/1998 | May et al. | 399/170 X |

FOREIGN PATENT DOCUMENTS

| | | | |
|---|---|---|---|
| 63-50877 | 3/1988 | Japan | 399/173 |

*Primary Examiner*—William J. Royer
*Attorney, Agent, or Firm*—BakerBotts, LLP

[57] ABSTRACT

The specification discloses an electrophotographic image forming system. The system includes a photoconductor connected to a first electric potential constituting substantially an elongated cylindrical drum provided for rotating around an axis along an elongated direction of the cylindrical drum having an external charging surface disposed thereon. The electrophotographic system further includes a non-contact charger which includes a plurality of mutually insulated conductive films each having a sharp edge pointing perpendicularly to the charging surface. The non-contact charger further includes a packaging frame for securely attaching to and supporting the plurality of mutually insulated conductive films thereon. The plurality of mutually insulated conductive films are connected to a second electric potential different from the first electric potential for activating an electric discharge between the sharp edges of the conductive film and the charging surface.

31 Claims, 6 Drawing Sheets

CHARGING DEVICE FOR AN ELECTROPHOTOGRAPHIC IMAGING FORMING SYSTEM UTILIZING THIN FILM CONDUCTING MEMBERS

REFERENCE TO RELATED APPLICATION

This application claims the benefit of U.S. Provisional Application Ser. No. 60/027,535, filed Oct. 7, 1996.

BACKGROUND OF THE INVENTION

1. Field of the Invention

This invention relates generally to an electrophotographic system and the method and configuration for manufacturing a charger as a key component for assembling such a system for performing a charging operation therein. More particularly, this invention relates to a novel non-contact charger for an electrophotographic system for reproducing an image wherein the charger can be manufactured at a lower cost by implementing a novel structure such that the charger can be operated at a lower charging voltage with a higher efficiency and producing a highly uniform charged surface over a broader area of a photoconductor surface whereby electrophotographic images can be more reliably produced with better uniformity.

2. Description of the Prior Art

Several technical difficulties and limitations are faced by those who apply a conventional electrophotographic technology to reproduce images by first charging a photoconductor surface with a non-contact charger before exposing the charged surface to light illumination for image reproduction. In carrying out the electrophotographic processes, including the steps of charging, exposure, developing, transferring, fixing and cleaning, a uniform charging current must be maintained across the width of the photoconductor, and the charge current must be kept substantially at a stable constant level under a variety of environmental conditions. The corona type of chargers which employ a bare wire suspended above the photoconductor for charging the photoconductor surface suffers a non-uniform emission. A tendency exists for some areas of the surface of the photoconductor to be overcharged or undercharged. Consequently, a grid which is biased must be provided between the bare wire and the photoconductor surface to control the charge level. Manufacture costs are increased due to this additional grid requirement.

In addition, a very high voltage, e.g., 5000–8000 volts, has to be used for the charging operation. Due to this high voltage requirement, more expensive circuits and precaution measures for protection against high voltage breakdown or accidents are necessary. Furthermore, a large amount of corona discharge products such as ozone are generated during a high voltage discharge operation. These discharge products may cause the surface of the photoconductor to deteriorate which leads to degradation and blurring of the image quality. Also, as will be further explained below, the chargers according to the state-of-the-art design as currently available, are operated at a very low efficiency level wherein large percentages of power are consumed without being actually utilized to produce ions useful for image reproduction. Waste of power and generation of unnecessary heat and high temperature thus resulted from this difficulty in operating the electrophotographic systems at a very low efficiency level. In addition, due to the difficulties associated with low efficiency, a charger structured with a thin wire to which a high voltage is applied further generates another problem that the wire can be damaged by an excessive current conducted through the thin wire if it is not carefully controlled. Reliable operation of an electrophotographic system is adversely affected by a damaged wire causing a malfunction to the non-contact charger.

FIGS. 1A and 1B show a prior art charger commonly employed in a conventional electrophotographic system. The charger includes a metal wire 2 which is about 0.5 millimeters in diameter and is placed parallel to the surface of a photoconductor 1 with a small gap ranging from one to two millimeters between the wire 2 and the photoconductor 1. A metal cover 3 is then used to cover the wire 2. With a substratum 4 of the photoconductor 1 and the metal cover 3 connected to a ground potential, a high direct current voltage which is generally higher than 8,000 volts is then applied to the metal wire 2. A corona electric discharge is induced between the wire 2 and the photoconductor 1. A plurality of ions are generated from the corona discharge and the ions are deposited on the surface of the photoconductor 1. A pre-designated level of electric potential is produced on the surface of the photoconductor 1. The surface of the photoconductor 1 on which the ions are deposited becomes a recording area ready to pass through an exposure station to be exposed to images for reproducing the images therefrom. The metal cover 3 is employed to serve a function of absorbing excess ions to prevent these excessive ions from being released into the air. As large amounts of excessive ions are being absorbed by the cover 3, only a small percentage of power is effectively utilized to generate charging ions applied to charge the surface of the photoconductor 1.

Many U.S. patents are related to corona chargers used in electrophotographic systems. The chargers disclosed in these prior art patents are all related to chargers formed by use of a wire or pair of wires applied with very high voltages. One example of such a patent is by Fukushima et al., i.e., U.S. Pat. No. 5,512,983, issued on Apr. 30, 1996, entitled "Electrophotographing Apparatus with First and Second Charge Devices". This patent discloses an electrophotography apparatus with a photosensitive body, first charge devices for performing a first charge process to form an image on the photosensitive body. It also includes a transfer charger for transferring the image formed on the photosensitive body onto a transfer material. A potential applying device is used for setting the photosensitive body at a predetermined potential by simultaneously performing a second charge process having the same polarity as a polarity of the first charge process. The primary charger and the transfer charger are both configurations as wire-type chargers.

Similar charger configurations where the discharging electrode is structured as a wire are disclosed in many other U.S. patents. A few examples of such patents related to non-contact chargers for electrophotographic systems are U.S. Pat. No. 4,484,812 (high voltage transformer for driving a wire-type discharging electrode), U.S. Pat. No. 4,430,686 (discharge wire-pair), U.S. Pat. No. 4,507,373 (two corona wire charger for improving charge uniformity), U.S. Pat. No. 4,914,480 (an end block for a corona discharging device for improving shield and insulation), U.S. Pat. No. 5,272,507 (discharging wires and grid to accelerate the potential of the photoconductive element to rise and fall rapidly), U.S. Pat. No. 5,276,483 (humidity control for wire-type charger), U.S. Pat. No. 5,426,489 (magnetic brush contact type charger), U.S. Pat. No. 5,465,135 (time counter to control the discharging operation of the corona wire-type chargers), and U.S. Pat. No. 5,495,316 (control the starting time of the wire charger to shorten the print time). All these chargers with wire-types of discharging electrodes are faced with the same difficulties that these wires are operated with high voltages, low efficiency, susceptibility to wire damages, and non-uniform charging quality.

In U.S. Pat. No. 5,075,703, entitled "Ribbon Coronode" (issued on Dec. 24, 1991), Bergen discloses a charging device which includes a thin conductive strip where the edge is used as a coronode. The concept of employing the edge of the ribbon for inducing a charging operation is very useful. However, the requirement of applying a high voltage due to low efficiency is not resolved due to the fact that the ribbon coronode is only a single layer and would not provide sufficient and uniform electrical discharging activities to efficiently utilize the electric power provided to the charging system. Additionally, the structure of the ribbon coronode would be weak and unlikely to sustain long term operation. For these reasons, a ribbon charging system as that shown in Bergen would not provide an effective solution to resolve the difficulties faced by those involved in image formation applying the technology of electrophotography.

Therefore, a need still exists in the art of electrophotographic systems to provide a new system configuration and charger design and manufacturing method to resolve these difficulties and limitations. More specifically, chargers structured according to this new system configuration and design approach must be provided for operation with lower voltage, and higher efficiency, while providing reliable performance characteristics and resolving the difficulty of damage-susceptibility commonly occurring to the wire-type chargers. It is further desirable that the chargers can be manufactured at lower costs while having smaller volume to allow the electrophotographic system to be further miniaturized.

SUMMARY OF THE PRESENT INVENTION

It is therefore an object of the present invention to provide a new configuration for an electrophotographic charger which has a plurality of sharp tips or edges for discharging to a photoconductive surface such that the charger can be operated at a lower voltage and higher efficiency to overcome the aforementioned difficulties and limitations encountered in the prior art.

Specifically, it is an object of the present invention to provide a new configuration for an electrophotographic charger which has a plurality of sharp tips or edges for discharging to a photoconductive surface wherein one preferred embodiment of such chargers is structured with a plurality of mutually insulated conductive thin films with sharp edges of the thin film facing the photoconductive surface for discharging thereto.

Another object of the present invention is to provide a new configuration for an electrophotographic charger provided with a plurality of sharp tips or edges for discharging to a photoconductive surface wherein such chargers can be structured flexibly as multiple layered thin films, conductive lines formed on a printed circuit board (PCB) or elongated strips formed by pressing mutually insulated thin conductive films such that the chargers can be manufactured with simplified methods with low production cost.

Another object of the present invention is to provide a new configuration for an electrophotographic charger provided with a plurality of sharp tips or edges for discharging to a photoconductive surface wherein such chargers can be structured flexibly as multiple layered thin films, conductive lines formed on a printed circuit board (PCB) or elongated strips formed by pressing mutually insulated thin conductive films such that the chargers can be manufactured with smaller volume thus allowing the electrophotographic system to be further miniaturized.

Another object of the present invention is to provide a new configuration for an electrophotographic charger provided with a plurality of sharp tips or edges for discharging to a photoconductive surface wherein such chargers can be structured flexibly as multiple layered thin films, conductive lines formed on a printed circuit board (PCB) or elongated strips formed by pressing mutually insulated thin conductive films such that the chargers can be operated with more reliability without being susceptible to wire damage as have occurred for the conventional corona chargers.

Briefly, in a preferred embodiment, the present invention comprises an electrophotographic system. The system includes a photoconductor connected to a first electric potential and constituting substantially an elongated cylindrical drum supported for rotation around an axis extending along an elongated direction of the cylindrical drum having an external charging surface disposed thereon. The electrophotographic system further includes a non-contact charger which includes a plurality of mutually insulated conductive films each having a sharp edge pointing toward the charging surface. The non-contact charger further includes a packaging frame for securely attaching to and supporting the plurality of mutually insulated conductive films thereon. The plurality of mutually insulated conductive films are connected to a second electric potential different from the first electric potential for activating an electric discharge between the sharp edges of the conductive film and the charging surface.

These and other objects and advantages of the present invention will no doubt become obvious to those of ordinary skill in the art after having read the following detailed description of preferred embodiments which are illustrated in the various drawing figures.

DETAILED DESCRIPTION OF THE PREFERRED EMBODIMENTS

Figure 1A:
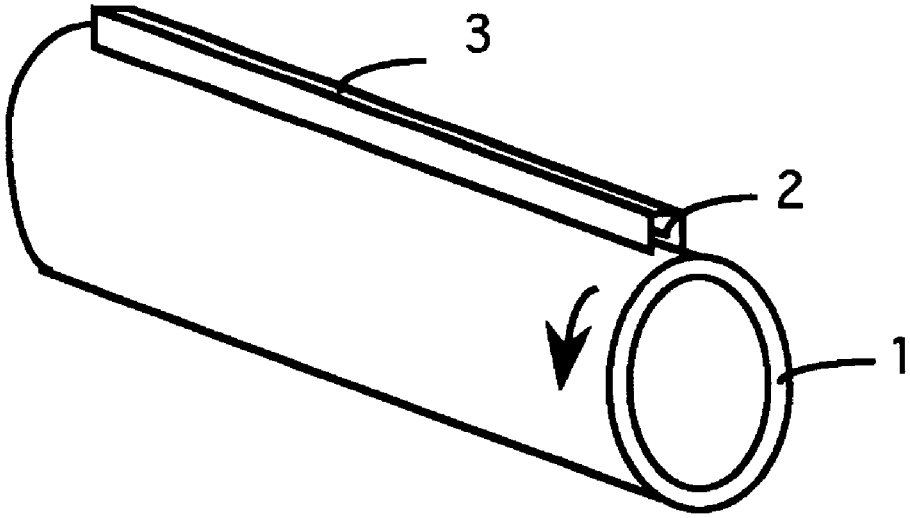
FIG. 1A (Prior Art)
FIGS. 1A and 1B show a perspective view and a cross sectional view respectively of a charger for an electrophotographic system according to the prior art design.
Figure 1B:
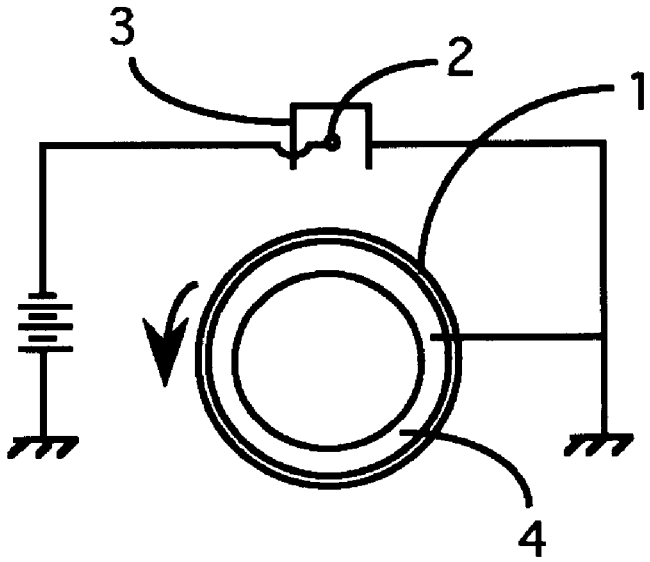
FIG. 1B (Prior Art)
Figure 2A:
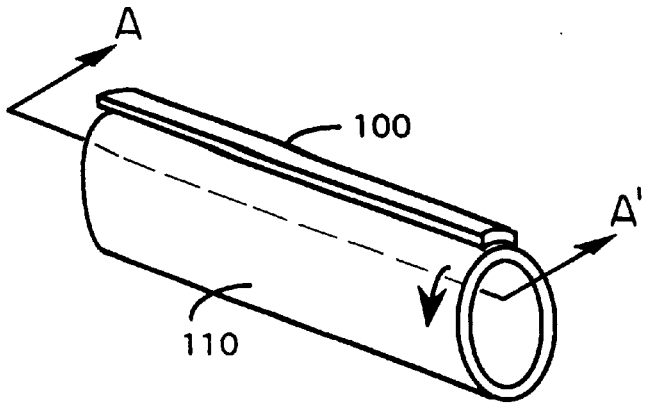
FIGS. 2A and 2B show the perspective view and a cross sectional view respectively of a charger of the present invention.
Figure 2B:
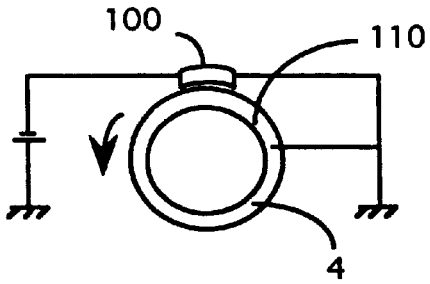

FIGS. 2A and 2B show a perspective view and a cross sectional view respectively for a multiple-layer charger 100 for charging the surface of a photoconductor 110 according to a novel structure of this invention. The photoconductor 110 can be either cylindrical or belt-shaped and composed of different kinds of materials such as selenium, cadmium, sulfide, zinc oxide, amorphous silicon, or an organic composition. Instead of a conductive wire as that employed in the prior art charger, the charger 100 employs a multiple-layer structure. The main characteristic of the present invention is a novel charger structure which is configured to provide multiple conductive lines with sharp edges facing the surface of the photoconductor 110, the conductive lines each having a sharp edge arranged to point these edges perpendicularly toward the surface of the photoconductor surface. These sharp edges of the conductive lines are also arranged to point in a direction perpendicular to the direction of rotation of the photoconductor 110, as shown by an arrow in FIG. 2B. In a preferred embodiment, the charger 100 may further include a metal frame (not shown) surrounding the multiple-layer charger 100 and connected to a ground potential to function as a shield for the charger 100. Excess ions are absorbed by the metal frame to avoid electrical arcing. The distance between the surface of the photoconductor 110 and the tip of the multiple-layer charger 100 is in a range from 0.1 mm to 1.0 mm and is preferably between 0.2 mm to 0.5 mm.

Figure 3:
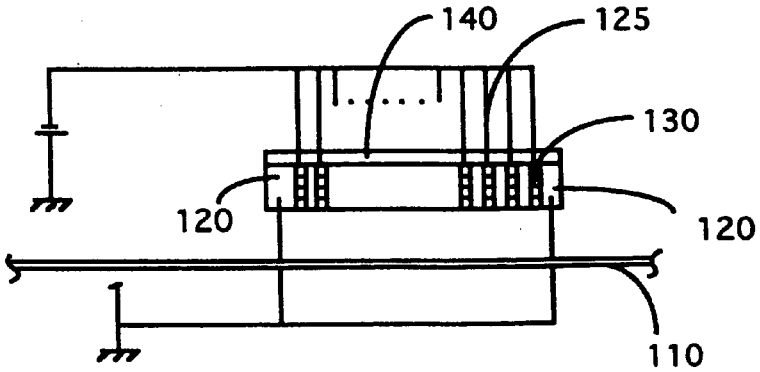
FIG. 3 is a cross sectional view of the charger showing the structural details according to one preferred embodiment of the present invention.

Refer to FIG. 3 for a functional diagram showing more details of the structure of the multiple-layer charger 100 which has a ground terminal 120 connected to a ground potential. The photoconductor 110 is also connected to the ground potential while multiple-layer conductive film electrodes 125 are connected to a negative voltage source which provides a voltage of approximately −2000 volts to each of the conductive film electrodes 125. A film insulating layer 130 is disposed between every adjacent pair of conductive film electrodes 125. These conductive film electrodes 125 are attached to an insulated frame structure 140 to support and fix these multiple-layer conductive film electrodes 125 and the film insulating layers 130 in their respective locations. In a preferred embodiment, six conductive film electrodes 125 and seven film insulating layers 130 are employed for constructing a charger. The conductive film electrodes 125 are made of Ni—Cr alloy and the film insulating layers are composed of glass, epoxy or Teflon. The multiple-layer charger 100 is placed at a distance away from the photoconductor 110 such that the electrical field produced by the high voltage applied to the conductive film electrodes 125 is concentrated in the gap between the charger 100 and the photoconductor 110, so that ions are produced for charging the surface of the photoconductor 110.

Figure 4A:
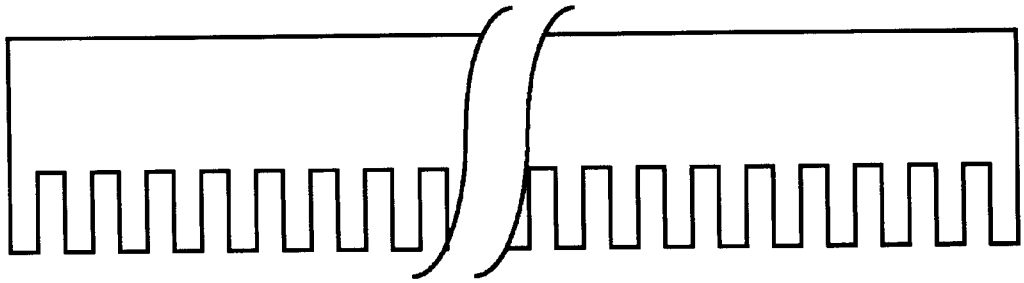
FIGS. 4A to 4C are schematic cross sectional views taken along A–A' in FIG. 2A showing three possible shapes of the conductive film electrodes.
Figure 4B:
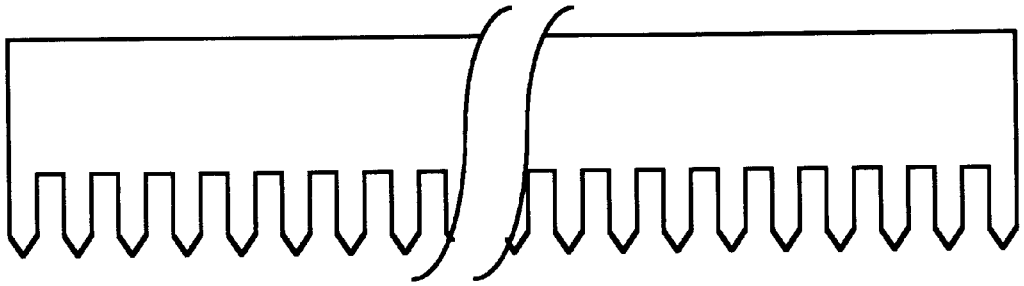
Figure 4C:
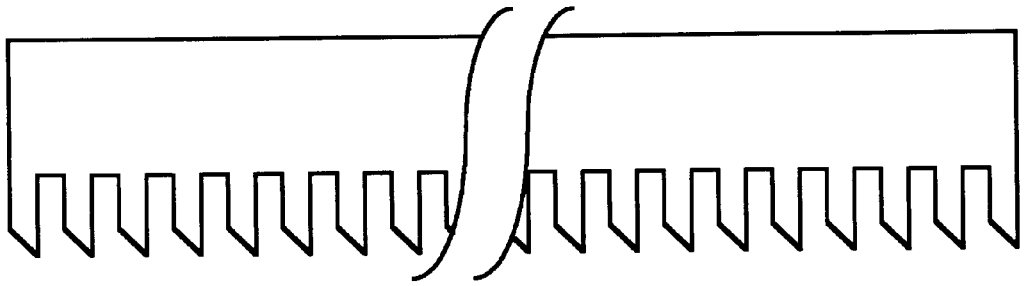
Figure 5:
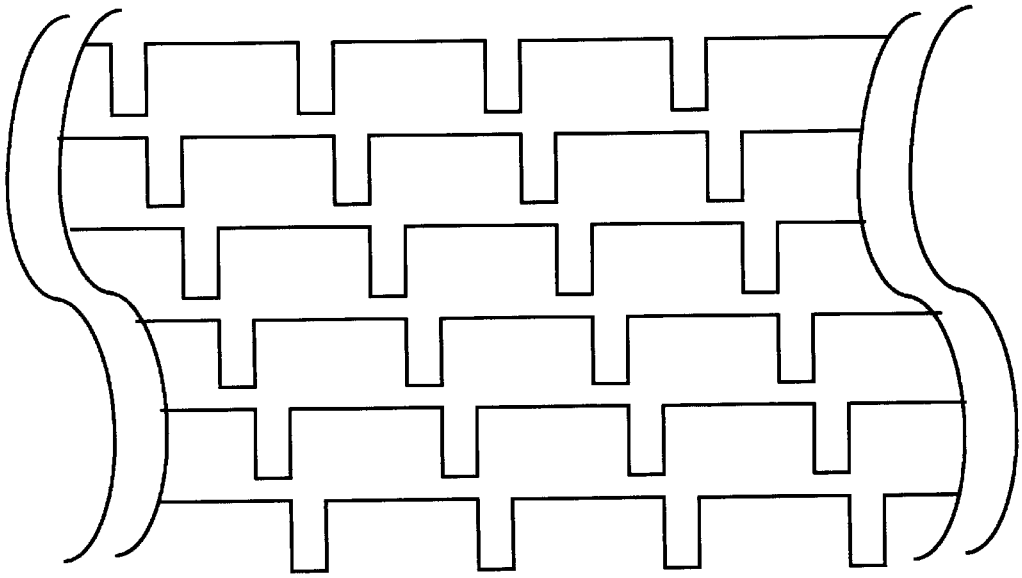
FIG. 5 is a schematic view showing the offset relationship among the multi-layer films shaped with serrated edges as that shown in FIGS. 4A to 4C.
Figure 6:
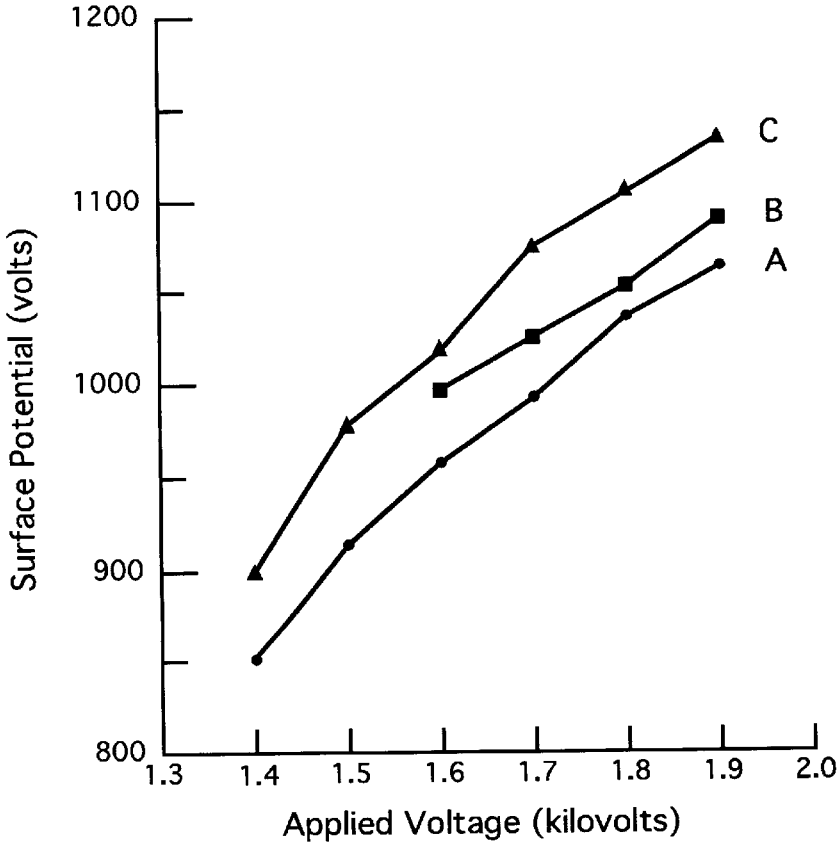
FIG. 6 shows the surface potential in negative volts, i.e., −V, versus the applied voltage in an unit of −KV.

Further details of the tips of the multiple conductive film electrodes 125 are shown as cross sectional views in FIGS. 4A to 4C. The tips of the conductive film electrodes can be a rectangular, triangular, or one-side tapered-end shape. These special shapes may enhance the effect of corona discharge produced by these conductive film electrodes. For the purpose of increasing the uniformity of the electric field in the gap, the multiple tips of one of the serrated edges are offset from those of other serrated edges as that shown in FIG. 5. FIG. 6 shows the surface potential in a negative voltage, i.e., −V (volt), versus the applied voltage in the unit of −kV for the first preferred embodiment described above. Specifically, curve A represents the condition in which eight conductive film electrodes 125 having no serrated edge and with a gap of 0.3 mm. Curve B represents the condition in which six conductive film electrodes 125 each having a serrated edge with a gap of 0.5 mm, and curve C represents the condition in which six conductive film electrodes 125 each having a serrated edge with a gap of 0.2 mm. As shown in FIG. 6, the conductive film electrodes with a serrated edge provide a special advantage that for the purpose of producing the same surface potential, a lower voltage is required when compared to the voltage required for the conductive film electrodes with no serrated edges. The conductive film electrodes with serrated edges further provide another advantage that for the purpose of producing the same surface potential when the same voltage is applied, a larger gap can be implemented in comparison to the gap required for the conductive film electrodes with no serrated edges. The flexibility of allowing greater gaps by the use of the conductive film electrodes with serrated edges simplifies the manufacturing process and increases the uncertainty tolerances. In addition to the serrated edges, improvement in charge uniformity can be achieved by providing a grid between the charger 100 and the photoconductor 110. The serrated edges of the conductive film electrodes can also be coated with a semiconductor layer of high resistivity, e.g., $1\times10^6$ to $1\times10^8$ ohm-cm to prevent electrical arcing.

Figure 7A:
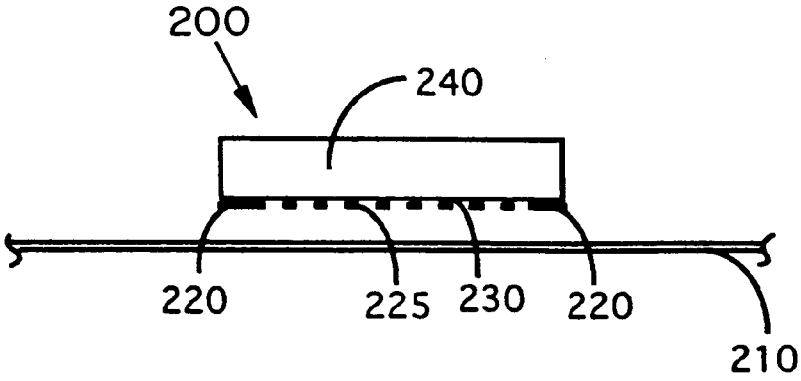
FIGS. 7A and 7B are a cross sectional view and a bottom view respectively of a charger according to another preferred embodiment of the present invention.
Figure 7B:
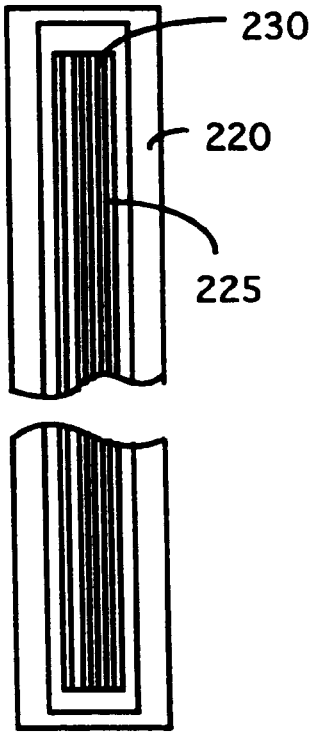

FIG. 7A shows a cross sectional view and FIG. 7B shows a bottom view of the structure of another preferred embodiment for the charger 200 of this invention. As that shown in FIG. 7A, the non-contact charger 200 is structurally supported by the printed circuit board (PCB) 240 with the multiple layer conductive film wires 225 formed on the PCB facing down with thin wires pointing to the surface of the photoconductor 210 wherein each thin wire electrode is disposed next to an insulating gap 230. As shown in FIG. 7B, the PCB 240 supports a ground terminal 220 on the peripheral portion of the PCB 240 while the conductive film wires 225 with the insulating gaps 230 disposed between these film wires 225 are securely printed on the PCB in the central portion of the PCB 240.

Figure 8A:
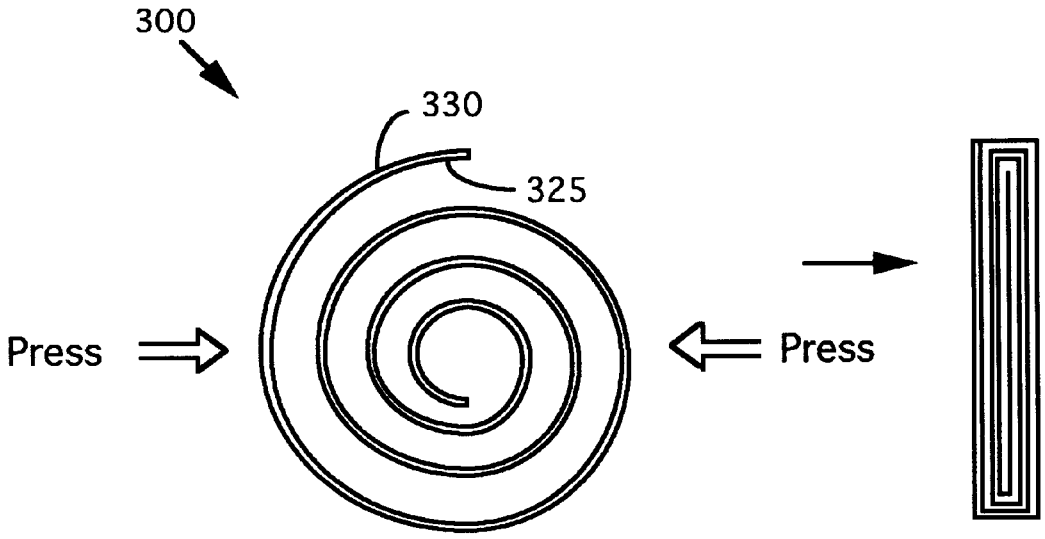
FIGS. 8A and 8B are diagrams to show the manufacture processes of two alternate methods for making a charger of the present invention.
Figure 8B:
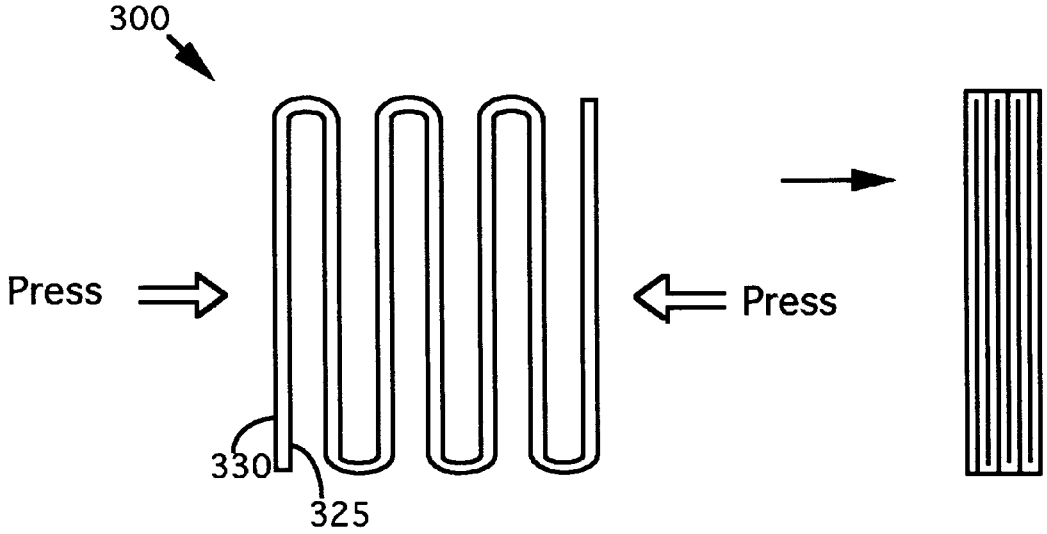

According to the structure for the non-contact charger 200 as described above, a low cost manufacture process can be applied to mass produce the non-contact charger comprising multiple layers of conductive film electrodes 325 at a very low cost. FIGS. 8A and 8B show two alternate techniques to produce such a multiple layer high efficiency charger 300. The conductive film electrodes 325 can be produced, according to FIG. 8A, by wrapping a thin film together with an insulative film in a spiral manner. Then the films are pressed to fit as an elongated strip according to the dimension suitable for fitting on top of the photoconductor surface to perform the charging function. In an alternate method as that shown in FIG. 8B, the thin films when attached to each other, i.e., the conductive film electrodes 325 attached to the insulative film 330, can be wound in upward and downward directions alternately in a sinuous path and then pressed together again to an elongate strip shape for packaging onto the frame 140 and connected to the terminal for applying voltage thereon and function as a charger.

The non-contact charger 100 with this novel structural features provides several advantages. First of all, because the air discharge process is accomplished between the sharp edges of the conductive film electrodes 125 facing the surface of the photoconductor, lower voltage can be applied. The sharp edge discharge can be accomplished when the conductive film electrodes are supplied with a voltage around −2000 volts instead of a much higher voltage of approximately −8000 volts required for a conventional charger. The inconveniences which usually arise from applying high voltage to the circuit elements are now eliminated by implementing this novel structure for constructing the non-contact charger. Additionally, since the sharp edges pointing toward the surface of the photoconductor 110 comprise horizontal layers configured parallel to the surface, and the sharp edges of these multiple layers can be configured to cover broader area over the entire length of the charger 100 above the photoconductor 110. Very uniform discharging of the air in the gap between the charger 100 and the photoconductor can be achieved by properly arranging the multiple layer conductive film electrodes to cover the necessary areas over the photoconductor 110.

Since the charger 100 can be manufactured with thin conductive films attached to insulative film as that described above, in addition to the advantage that mass production can be conveniently carried out, such charger can also be manufactured to have miniaturized size. A charger as that shown in FIG. 4B can also be produced by printed circuit board technology. Again, the structure can be easily mass produced with large quantity at low cost. Furthermore, modern technology for integrated circuit (IC) manufacture and packaging can be easily applied to miniaturize the charger such that charger of smaller volume, and high efficiency and high performance can be produced by implementing the structure disclosed in this invention.

Compared to the single wire or wire-pair system as commonly applied in the prior art, the packaged charger with multiple layer thin film structure can be very precisely placed at a location which is closer to the photoconductor 110. By shortening the distance between the charger 100 and the photoconductor, the charger 100 is operated at much higher efficiency as most of the power applied to the charger 100 is utilized to produce ions for charging the surface of the photoconductor 110. Because of the higher efficiency, lower amounts of excessive ions are being released to the air. Less ozone is released. The cover of a conventional charger used to absorb the excessive ions is no longer required. The cost of manufacturing and applying the charger in an electrophotographic system is further reduced by simplifying the structure of the charger system according to this novel structure.

According to FIGS. 2A to 5, an electrophotographic system is disclosed in this invention which includes a photoconductor 110 connected to a first electric potential constituting substantially an elongated cylindrical drum provided for rotating around an axis extending along an elongated direction of the cylindrical drum having an external charging surface disposed thereon. The electrophotographic system further includes a non-contact charger 100 which includes a plurality of mutually insulated conductive films each having a sharp edge pointing perpendicularly to the charging surface. The non-contact charger 100 further includes a packaging frame 140 for securely attaching to and supporting the plurality of mutually insulated conductive film electrodes 125 thereon. The plurality of mutually insulated conductive film electrodes 125 are connected to a second electric potential different from the first electric potential for activating an electric discharge between the sharp edges of the conductive film electrodes 125 and the charging surface. In a preferred embodiment, the non-contact charger 100 extends parallel to the elongated axis of the cylindrical drum 110. In an alternate preferred embodiment, the sharp edges of the non-contact charger are disposed at a distance ranging between 0.1 to 1.0 millimeter from the charging surface. In another preferred embodiment, the photoconductor 110 is connected to a ground potential and the mutually insulated conductive film electrodes are connected to a second electric potential ranging from −1500 to −3000 volts. In another preferred embodiment, the non-contact charger 100 further includes a plurality of insulating films 130 each attaching to one of the conductive film electrodes 125 for disposing between every adjacent pair of the conductive film electrodes 125 for providing insulation thereto. In yet another preferred embodiment, the plurality of mutually insulated conductive film electrodes 125 with the sharp edges disposed on the non-contact charger are provided by a plurality of printed thin conductive lines disposed on a printed circuit board. In yet another preferred embodiment, according to FIG. 5, the plurality of mutually insulated conductive film electrodes 125 with the sharp edges disposed on the non-contact charger 100 are provided by pressing a spirally wound conductive thin film to produce an elongated strip constituting the charger 100.

In summary, according to the drawings and description provided above, this invention discloses a charger 100 for charging a photoconductor surface which includes a plurality of conductive tips provided with a discharge voltage relative to a charging surface of the photoconductor 110 for discharging thereto. In a preferred embodiment, this invention discloses a charging device for charging a recording means employed in an image forming apparatus. The charging device includes a charging means which includes a plurality of mutually insulated elongated conductive film electrodes each having a sharp edge disposed near the recording means wherein the charging means is provided to connect to a charging voltage for generating a discharge from the sharp edge to the recording means. In a preferred embodiment, each of the mutually insulated elongated conductive film electrodes has a serrated edge at a side near the recording means. In yet another preferred embodiment, similar to that often applied in the conventional electrophotographic systems and well known in the art, the charging device further includes a grid disposed between the charging means and the recording means.

Based on the drawings and descriptions included in this invention, a method for manufacturing a charging device for charging a recording means employed in an image forming apparatus is also disclosed. The method includes the steps of (a) employing a charging means which includes a plurality of mutually isolated elongated conductive film electrodes each having a sharp edge disposed near the recording means; and (b) providing to the charging means a charging voltage for generating a discharge from the sharp edge to the recording means. This invention further includes a method for designing and manufacturing an electrophotographic image forming system. The method includes the steps of (a) connecting a first electric potential to a photoconductor constituting substantially an elongated cylindrical drum provided for rotating around an axis along an elongated direction of the cylindrical drum having an external charging surface disposed thereon; (b) employing a non-contact charger with a plurality of mutually insulated conductive film electrodes each having a sharp edge pointing perpendicularly to the charging surface; (c)securely attaching and supporting the plurality of mutually insulated conductive film electrodes of the non-contact charger with a packaging frame; and (d) connecting the plurality of mutually insulated conductive film electrodes to a second electric potential different from the first electric potential for activating an electric discharge between the sharp edges of the conductive film electrodes and the charging surface.

Therefore, the present invention provides a new configuration for an electrophotographic charger which includes a plurality of sharp tips or edges for discharging to a photoconductive surface such that the charger can be operated at a lower voltage and higher efficiency such that the difficulties and limitations encountered in the prior art are resolved.

Specifically, the new charger is structured with a plurality of mutually insulated conductive film electrodes with sharp edges of the film electrodes facing the photoconductive surface for discharging thereto. Also, the plurality of sharp tips or edges for discharging to a photoconductive surface can be structured flexibly as multiple layered thin films or conductive lines formed on a printed circuit board (PCB) or elongated strips formed by pressing mutually insulated thin conductive films such that the chargers can be manufactured with simplified methods at low production cost. Furthermore, the chargers can be manufactured to occupy small volume to allow the electrophotographic system to be further miniaturized. With the new configuration, the chargers can be operated with more reliability without being susceptible to wire damage as has occurred in the conventional corona chargers.

Although the present invention has been described in terms of the presently preferred embodiments, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

We claim:

1. An electrophotographic image forming system comprising:

a photoconductive member having a charge-receiving surface for forming an electrostatic charge image; and a charging device disposed adjacent to the charge-receiving surface;

wherein the charging device comprises a plurality of substantially parallel thin film conductive members each having a charge-emitting edge facing the charge-receiving surface and formed with a series of spaced projecting tips extending toward the charge-receiving surface to apply charge thereto; and wherein each adjacent pair of thin film conductive members is separated by a layer of insulating material.

2. An electrophotographic image forming system according to claim 1 wherein the photoconductive member is a cylindrical drum and the charging device extends parallel to the axis of the drum.

3. An electrophotographic image forming system according to claim 1 wherein the charge-emitting edges of the thin film conductive members are spaced from the charge-receiving surface by a distance in the range from about 0.1 mm to about 1.0 mm.

4. An electrophotographic image forming system according to claim 1 wherein a potential difference in the range from about 1500 to 3000 volts is applied between the photoconductive member and the thin film conductive members.

5. An electrophotographic image forming system according to claim 1 wherein the spaced projecting tips have a rectangular tip configuration.

6. An electrophotographic image forming system according to claim 1 wherein the spaced projecting tips have a triangular configuration.

7. An electrophotographic image forming system according to claim 6 wherein the spaced projecting tips in the charge-emitting edges of adjacent thin film conductive members are offset from each other.

8. An electrophotographic image forming system according to claim 1 wherein the spaced projecting tips have a one-sided tapered end shape.

9. An electrophotographic image forming system comprising:

a photoconductive member having a charge-receiving surface for forming an electrostatic charge image; and a charging device disposed adjacent to the charge-receiving surface;

wherein the charging device comprises a plurality of substantially parallel thin film conductive members each having a charge-emitting edge facing the charge-receiving surface to apply charge thereto;

wherein each adjacent pair of thin film conductive members is separated by a layer of insulating material; and wherein the plurality of substantially parallel thin film conductive members and layers of insulating material separating adjacent pairs of members are provided by an elongated strip of insulating film having conductive film coated on a surface of the strip and arranged with a plurality of portions of the insulating film strip and of the conductive film disposed in side-by-side relation.

10. An electrophotographic image forming system according to claim 9 wherein the elongated strip is spirally wound to form adjacent layers of insulating film and conductive film and pressed together.

11. An electrophotographic image forming system according to claim 9 wherein the elongated strip is arranged in a sinuous path and pressed together.

12. A charging device for depositing electrostatic charge on a charge-receiving surface in an image forming system comprising:

a plurality of substantially parallel thin film conductive members each having a charge-emitting edge facing in the direction of a charge-receiving surface and formed with a series of spaced projecting tips extending toward the charge-receiving surface to apply charge thereto; and a layer of insulating material disposed between each adjacent pair of thin film conductive members.

13. A charging device according to claim 12 wherein the spaced projecting tips have a rectangular tip configuration.

14. A charging device according to claim 12 wherein the spaced projecting tips have a triangular configuration.

15. A charging device according to claim 12 wherein the spaced projecting tips have a one-sided tapered end shape.

16. A charging device according to claim 12 wherein the spaced projecting tips in the charge-emitting edges of adjacent thin film conductive members are offset from each other.

17. A charging device according to claim 12 including an insulating support member for supporting the plurality of thin film conductive members and insulating layers.

18. A charging device according to claim 12 wherein each of the thin film conductive members is a metallic film.

19. A charging device according to claim 18 wherein each of the thin film conductive members is a film of nickel-chromium alloy.

20. A charging device according to claim 12 wherein the insulating layer is an epoxy insulating layer.

21. A charging device according to claim 12 wherein the insulating layer is a glass layer.

22. A charging device according to claim 12 including means for connecting the thin film conductive members to a voltage source providing a potential difference with respect to the charge-receiving surface in the range from about 1500 to 3000 volts.

23. A charging device according to claim 12 including means for supporting the charge-emitting edges of the thin film conductive members at a distance in the range of about 0.1 to 1.0 mm. from the charge-receiving surface.

24. A charging device according to claim 23 including means for supporting the charge-emitting edges of the thin film conductive members at a distance in the range from about 0.1 to 0.3 mm from the charge-receiving surface.

25. A charging device according to claim 12 including a coating on the charge-emitting edges of the thin film conductive members having a resistivity in the range from about $1\times10^6$ to $1\times10^8$ ohm-cm to prevent electrical arcing.

26. A charging device for depositing electrostatic charge on a charge-receiving surface in an image forming system comprising:

a plurality of substantially parallel thin film conductive members each having a charge-emitting edge facing in the direction of a charge-receiving surface to apply charge thereto; and a layer of insulating material disposed between each adjacent pair of thin film conductive members; and wherein the plurality of substantially parallel thin film conductive members and layers of insulating material separating adjacent pairs of thin film conductive members are provided by an elongated strip of insulating film having a thin conductive film on one surface and arranged with portions of the insulating film and thin conductive film disposed in side-by-side relation.

27. A charging device according to claim 26 wherein the elongated strip of insulating film and attached thin conductive film is spirally wound and pressed together.

28. A charging device according to claim 26 wherein the elongated strip is arranged in a sinuous path and pressed together.

29. A method for making a charging device for charging a charge-receiving surface comprising forming a thin insulating member having a surface provided with a conductive thin film coating into an assembly of adjacent substantially parallel conductive thin film layers spaced by insulating layers and pressing the assembly together to provide an array of conductive thin film layers having charge-emitting edges.

30. A method of manufacturing a charging device according to claim 29 wherein a layer of insulating material having a conductive thin film coating is wound in a spiral manner and pressed together to form an elongated strip.

31. A method of manufacturing a charging device according to claim 29 wherein a layer of insulating material is disposed in a sinuous pattern and pressed together to form an elongated strip.

* * * * *